US006739143B1

(12) United States Patent
Kita et al.

(10) Patent No.: US 6,739,143 B1
(45) Date of Patent: May 25, 2004

(54) REFRIGERATING DEVICE

(75) Inventors: Koichi Kita, Osaka (JP); Ryuzaburo Yajima, Osaka (JP)

(73) Assignee: Daikin Industries, Ltd.

( * ) Notice: Subject to any disclaimer, the term of this patent is extended or adjusted under 35 U.S.C. 154(b) by 0 days.

(21) Appl. No.: 09/914,535

(22) PCT Filed: Mar. 1, 2000

(86) PCT No.: PCT/JP00/01183

§ 371 (c)(1),
(2), (4) Date: Aug. 30, 2001

(87) PCT Pub. No.: WO00/52397

PCT Pub. Date: Sep. 8, 2000

(30) Foreign Application Priority Data

Mar. 2, 1999 (JP) ..... 11-054282

(51) Int. Cl.[7] ..... F25B 41/00
(52) U.S. Cl. ..... 62/114
(58) Field of Search ..... 62/114, 467, 498, 62/502; 252/67

(56) References Cited

U.S. PATENT DOCUMENTS

| | | | | |
|---|---|---|---|---|
| 4,688,390 | A | | 8/1987 | Sawyer |
| 5,367,883 | A | | 11/1994 | Sakakibara et al. |
| 6,054,064 | A | * | 4/2000 | D'Aubarede et al. ..... 252/67 |

FOREIGN PATENT DOCUMENTS

| | | |
|---|---|---|
| EP | 0 647 701 A | 4/1995 |
| JP | 4-306463 | 10/1992 |
| JP | 07064922 | 3/1995 |
| JP | 10325624 | 8/1998 |
| JP | 10-246520 | 9/1998 |
| JP | 11-63735 | 3/1999 |
| WO | WO 98/41803 | 9/1998 |
| WO | WO 99/31444 | 6/1999 |

OTHER PUBLICATIONS

P. J. Rapin, "Installation frigorifiques Tome 2", Mar. 1988, PYC Edition, Bayeux XP002209540 6997, p. 251–p. 258.
Microfilm of the specification and drawings annexed to the request of Japanese Utility Model Application No. 43914/1986 (Laid–open No. 156714/1987) (Toshiba Corporation), Oct. 5, 1987.
Nippon Reitou Kyoukai ed., "Jyoukyu Hyoujun Text Reito Kuchou Gijutsu", Jan. 20, 1988, pp. 126 to 143.
P.J. Rapin: "Installations Frigorifiques Tome 2" Mar. 1988, PYC Edition, Bayeux XP002209540 6997 *p. 251–p. 258*.

* cited by examiner

*Primary Examiner*—William C. Doerrler
*Assistant Examiner*—Malik N. Drake
(74) *Attorney, Agent, or Firm*—Nixon Peabody LLP; Donald R. Studebaker

(57) ABSTRACT

A refrigerant circuit (10) is formed by connecting, in series and in the order given, a compressor (11), a four-way selector valve (12), an outdoor heat exchanger (13), an expansion valve (14), and an indoor heat exchanger (15) by a gas side pipe (31) and a liquid side pipe (32). The refrigerant circuit (10) is charged with an R32 single refrigerant or with an R32/R125 mixed refrigerant in which R32 is present in an amount of not less than 75 wt. %. A dg/dl ratio, which is the ratio of the inside diameter dg of the gas side pipe (31) to the inside diameter dl of the liquid side pipe (32), is so set as to fall in the range of 2.1 to 3.5 when the cooling rated capacity is more than 5 kW but not more than 9 kW whereas when the cooling rated capacity is not more than 5 kW or more than 9 kW the dg/dl ratio is so set as to fall in the range of 2.6 to 3.5.

28 Claims, 6 Drawing Sheets

Fig. 3

| | | R22 | R407C | R410A | R134a | R32/125(75/25wt%) | R32 |
|---|---|---|---|---|---|---|---|
| ΔT | (℃) | 5 | 5 | 5 | 5 | 5 | 5 |
| ΔP | (kPa) | 86.13 | 85.86 | 135.05 | 56.92 | 138.66 | 138.49 |
| ΔT/ΔP | (℃/kPa) | 0.58 | 0.58 | 0.37 | 0.88 | 0.36 | 0.36 |
| Δh | (kJ/kg) | 154.39 | 157.07 | 154.82 | 142.13 | 195.72 | 238.79 |
| ρs | (kg/m$^3$) | 22.04 | 21.98 | 31.44 | 15.05 | 26.61 | 22.68 |
| HEAT TRANSFER PIPE INSIDE DIAMETER RATIO | | 1.00 | 0.99 | 0.85 | 1.21 | 0.80 | 0.76 |

Fig. 6

| | R22 | R407C | R410A | R134a | R32/125(75/25wt%) | R32 |
|---|---|---|---|---|---|---|
| HP (kPa) | 1899.1 | 2061.1 | 2996.9 | 1285.8 | 3072.32 | 3068.9 |
| LP (kPa) | 531.14 | 529.71 | 851.71 | 314.63 | 867.93 | 866.52 |
| $\Delta h$ (kJ/kg) | 154.39 | 157.07 | 154.82 | 142.13 | 195.72 | 238.79 |
| $\rho s$ (kg/m$^3$) | 22.04 | 21.98 | 31.44 | 15.05 | 26.61 | 22.68 |
| PIPE INSIDE DIAMETER RATIO | 1.00 | 0.97 | 0.85 | 1.19 | 0.80 | 0.76 |

| REFRIGERANT | GWP |
|---|---|
| R22 | 1500 |
| R407C | 1530 |
| R410A | 1730 |
| R134a | 1300 |
| R32 | 650 |

REFRIGERATING DEVICE

TECHNICAL FIELD

The present invention generally relates to refrigeration systems. This invention relates more particularly to a refrigeration system using a single refrigerant of R32 or a mixture of refrigerants containing R32.

BACKGROUND ART

Refrigerant R22, which is suitable for use as a refrigerant in refrigeration systems (e.g., air conditioning apparatus), has been used in many cases. However, R22, because of its high ozone depletion potential (ODP), is scheduled for total abolition by the year of 2020 according to the Montreal Protocol. Therefore, the development of various refrigerants as a replacement for R22 such as refrigerants R407C, R410A, and R134a is now proceeding.

PROBLEMS THAT THE INVENTION INTENDS TO SOLVE

As shown in FIG. 10, although these replacement refrigerants are low ODP refrigerants, their global warming potential (GWP) is similar to that of R22. Therefore, from the viewpoint of global warming prevention, the aforesaid replacement refrigerants are hardly acceptable.

Further, the use of these replacement refrigerants causes a refrigeration system to fall lower in COP (coefficient of performance) in comparison with currently-used conventional refrigerants. With the increase in power consumption the load of, for example, thermal power generation plants increases. This, apart from direct global warming due to refrigerant release, results in indirectly furthering global warming. There has been strong desires for the development of replacement refrigerants capable of truly contributing to the suppression of global warming.

Accordingly, the development of a single refrigerant of R32 or a mixture of refrigerants containing R32 in a great amount as a replacement refrigerant of low GWP is now proceeding.

However, that an existing refrigeration system designed for R22 is simply charged with a single refrigerant of R32 or with a mixture of refrigerants containing R32 will not take full advantage of the characteristics of R32, and it is impossible to sufficiently achieve global warming prevention. There have been strong demands for refrigeration systems capable of making good utilization of the characteristics of R32 for the purpose of global warming prevention.

Bearing in mind the above problems, the present invention was made. Accordingly, an object of the present invention is to provide a refrigeration system capable of making good utilization of the characteristics of R32 and of truly contributing to global warming prevention.

DISCLOSURE OF THE INVENTION

In order to achieve the above object, the present invention provides such arrangement that the diameter of a gas side pipe of a refrigerant circuit remains the same as a conventional gas side pipe whereas the diameter of a liquid side pipe is set smaller than that of a conventional liquid side pipe, whereby the refrigerant charging amount of the refrigerant circuit is reduced while maintaining the system performance at the same level as conventional technology.

More specifically, a first invention of the present application is intended for a refrigeration system comprising a refrigerant circuit (10) forming a refrigerating cycle. In the refrigeration system, a dg/dl ratio, which is the ratio of the diameter dg of a gas side pipe (31) of the refrigerant circuit (10) to the diameter dl of a liquid side pipe (32) of the refrigerant circuit (10), is not less than 2.6.

Further, another invention of the present application is intended for a refrigeration system which uses, as its refrigerant, either a mixture of not less than 75 wt. % but less than 100 wt. % R32 and R125 or a single refrigerant of R32 and which comprises a refrigerant circuit (10) forming a refrigerating cycle. In the refrigeration system, a liquid side pipe (32) and a gas side pipe (31) of the refrigerant circuit (10) are formed such that a dg/dl ratio, which is the ratio of the diameter dg of the gas side pipe (31) to the diameter dl of the liquid side pipe (32), is not less than 2.6.

By the "diameter" is meant an inside or outside diameter in each of the above-described inventions.

Further, another invention of the present application is intended for a refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of more than 5 kW but not more than 9 kW. In the refrigeration system, a liquid side pipe (32) and a gas side pipe (31) of the refrigerant circuit (10) are formed such that a dg/dl ratio, which is the ratio of the diameter dg of the gas side pipe (31) to the diameter dl of the liquid side pipe (32), is not less than 2.1.

Further, another invention of the present application is intended for a refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of more than 5 kW but not more than 9 kW. In the refrigeration system, a liquid side pipe (32) and a gas side pipe (31) of the refrigerant circuit (10) are formed such that a dg/dl ratio, which is the ratio of the diameter dg of the gas side pipe (31) to the diameter dl of the liquid side pipe (32), falls in the range of 2.1 to 3.5.

Furthermore, another invention of the present application is intended for a refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of more than 5 kW but not more than 9 kW. In the refrigeration system, a liquid side pipe (32) and a gas side pipe (31) of the refrigerant circuit (10) are formed such that a dg/dl ratio, which is the ratio of the diameter dg of the gas side pipe (31) to the diameter dl of the liquid side pipe (32), falls in the range of 2.4 to 3.2.

Further, another invention of the present application is intended for a refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of more than 5 kW but not more than 9 kW. In the refrigeration system, a liquid side pipe (32) and a gas side pipe (31) of the refrigerant circuit (10) are formed such that a dg/dl ratio, which is the ratio of the diameter dg of the gas side pipe (31) to the diameter dl of the liquid side pipe (32), falls in the range of 2.6 to 3.0.

Further, another invention of the present application is intended for a refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not more than 5 kW or more than 9 kW. In the refrigeration system, a liquid side pipe (32) and a gas side pipe (31) of the refrigerant circuit (10) are formed such that a dg/dl ratio, which is the ratio of the diameter dg of the gas side pipe (31) to the diameter dl of the liquid side pipe (32), is not less than 2.6.

Further, another invention of the present application is intended for a refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not more than 5 kW or more than 9 kW. In the refrigeration system, a liquid side pipe (32) and a gas side pipe (31) of the refrigerant circuit (10) are formed such that a dg/dl ratio, which is the ratio of the diameter dg of the gas side pipe (31) to the diameter dl of the liquid side pipe (32), falls in the range of 2.6 to 3.5.

Further, another invention of the present application is intended for a refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not more than 5 kW or more than 9 kW. In the refrigeration system, a liquid side pipe (32) and a gas side pipe (31) of the refrigerant circuit (10) are formed such that a dg/dl ratio, which is the ratio of the diameter dg of the gas side pipe (31) to the diameter dl of the liquid side pipe (32), falls in the range of 2.8 to 3.3.

Furthermore, another invention of the present application is intended for a refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not more than 5 kW or more than 9 kW. In the refrigeration system, a liquid side pipe (32) and a gas side pipe (31) of the refrigerant circuit (10) are formed such that a dg/dl ratio, which is the ratio of the diameter dg of the gas side pipe (31) to the diameter dl of the liquid side pipe (32), falls in the range of 2.9 to 3.1.

Further, another invention of the present application is intended for a refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not more than 5 kW. In the refrigeration system, a liquid side pipe (32) of the refrigerant circuit (10) is formed by a pipe the inside diameter of which is not more than 4.2 mm.

Furthermore, another invention of the present application is intended for a refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not more than 5 kW. In the refrigeration system, a liquid side pipe (32) of the refrigerant circuit (10) is formed by a pipe the inside diameter of which falls in the range of 3.2 mm to 4.2 mm.

Further, another invention of the present application is intended for a refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not more than 5 kW. In the refrigeration system, a liquid side pipe (32) of the refrigerant circuit (10) is formed by a pipe the inside diameter of which falls in the range of 3.5 mm to 3.9 mm.

Furthermore, another invention of the present application is intended for a refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not more than 5 kW. In the refrigeration system, a liquid side pipe (32) of the refrigerant circuit (10) is formed by a pipe the inside diameter of which falls in the range of 3.6 mm to 3.8 mm.

The inside diameter of the liquid side pipe (32) is preferably no more than 3.7 mm from the viewpoint of reducing the charging amount of refrigerant to a grater extent than conventional cases.

Further, another invention of the present application is intended for a refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of more than 5 kW but less than 22.4 kW. In the refrigeration system, a liquid side pipe (32) of the refrigerant circuit (10) is formed by a pipe the inside diameter of which is not more than 7.0 mm.

Furthermore, another invention of the present application is intended for a refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of more than 5 kW but less than 22.4 kW. In the refrigeration system, a liquid side pipe (32) of the refrigerant circuit (10) is formed by a pipe the inside diameter of which falls in the range of 5.4 mm to 7.0 mm.

Further, another invention of the present application is intended for a refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of more than 5 kW but less than 22.4 kW. In the refrigeration system, a liquid side pipe (32) of the refrigerant circuit (10) is formed by a pipe the inside diameter of which falls in the range of 5.7 mm to 6.7 mm.

Furthermore, another invention of the present application is intended for a refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of more than 5 kW but less than 22.4 kW. In the refrigeration system, a liquid side pipe (32) of the refrigerant circuit (10) is formed by a pipe the inside diameter of which falls in the range of 6.0 mm to 6.4 mm.

The inside diameter of the liquid side pipe (32) is preferably no more than 6.2 mm from the viewpoint of reducing the charging amount of refrigerant to a greater extent than conventional cases.

Further, another invention of the present application is intended for a refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not less than 22.4 kW. In the refrigeration system, a liquid side pipe (32) of the refrigerant circuit (10) is formed by a pipe the inside diameter of which is not more than 9.8 mm.

Furthermore, another invention of the present application is intended for a refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not less than 22.4 kW. In the refrigeration system, a liquid side pipe (32) of the refrigerant circuit (10) is formed by a pipe the inside diameter of which falls in the range of 7.5 mm to 9.8 mm.

Further, another invention of the present application is intended for a refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not less than 22.4 kW. In the refrigeration system, a liquid side pipe (32) of the refrigerant circuit (10) is formed by a pipe the inside diameter of which falls in the range of 7.8 mm to 9.5 mm.

Furthermore, another invention of the present application is intended for a refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not less than 22.4 kW. In the refrigeration system, a liquid side pipe (32) of the refrigerant circuit (10) is formed by a pipe the inside diameter of which falls in the range of 8.1 mm to 9.1 mm.

The inside diameter of the liquid side pipe (32) is preferably no more than 8.7 mm from the viewpoint of reducing the charging amount of refrigerant to a greater extent than conventional cases.

In each of the above-described inventions, the inside diameter of the liquid side pipe (32) of the refrigerant circuit (10) is set smaller than that of conventional liquid side pipes. Further, R32 single refrigerant or a mixture of not less than 75 wt. % but less than 100 wt. % R32 and R125 exhibits, as its refrigerant characteristic, less pressure loss than R22. Therefore even when the inside diameter of the liquid side pipe (32) is lessened, the tube pressure loss is maintained at the same level as conventional cases.

On the other hand, as the inside diameter of the liquid side pipe (32) is lessened, the refrigerant charging amount of the refrigerant circuit (10) is reduced. While maintaining the same performance that conventional R22 achieves, the charging amount of refrigerant is reduced. In addition to the fact that R32 has a low GWP, the refrigerant charging amount of the refrigerant circuit (10) is reduced. This considerably contributes to global warming effect reduction.

In each of the foregoing inventions, the liquid side pipe (32) may be the entirety of a pipe between the condenser outlet and the evaporator inlet or may be a part thereof. Likewise, the gas side pipe (31) may be the entirety of a pipe between the evaporator outlet and the condenser inlet, may be the entirety of a pipe between the evaporator outlet and the compressor suction side, or may be a part thereof.

The gas side pipe (31) and the liquid side pipe (32) may be connecting pipes for connecting an indoor unit (17) and an outdoor unit (16).

The liquid side pipe (32) may be a liquid side connecting pipe for connecting the indoor unit (17) and the outdoor unit (16).

In the above inventions, the length of connecting pipes is likely to be long, so that the refrigerant charging amount reduction effect is achieved more significantly.

Further, it is preferable that the refrigerant be an R32 single refrigerant.

EFFECTS OF THE INVENTION

As described above, in accordance with the present invention, the inside diameter of the liquid side pipe (32) is made smaller than conventional systems using R22. This makes it possible to reduce the refrigerant charging amount of the refrigerant circuit (10) while maintaining the performance at the same level as that of conventional systems. Accordingly, it becomes possible to make better use of an R32 single refrigerant or a mixture of refrigerants containing R32 in comparison with conventional cases. The reduction in GWP of refrigerant itself and the reduction in refrigerant charging amount considerably reduce the effect of global warming. Accordingly, systems suitable for preservation of the global environment.

BRIEF DESCRIPTION OF THE DRAWINGS

FIG. 3 is a table showing calculation results for the heat transfer pipe's inside diameter ratio.

FIG. 6 is a table showing calculation results for the liquid side pipe's inside diameter ratio.

BEST MODE FOR CARRYING OUT THE INVENTION

Hereinafter, embodiments of the present invention will be described with reference to the drawings.

Air Conditioning Apparatus Structure

Figure 1:
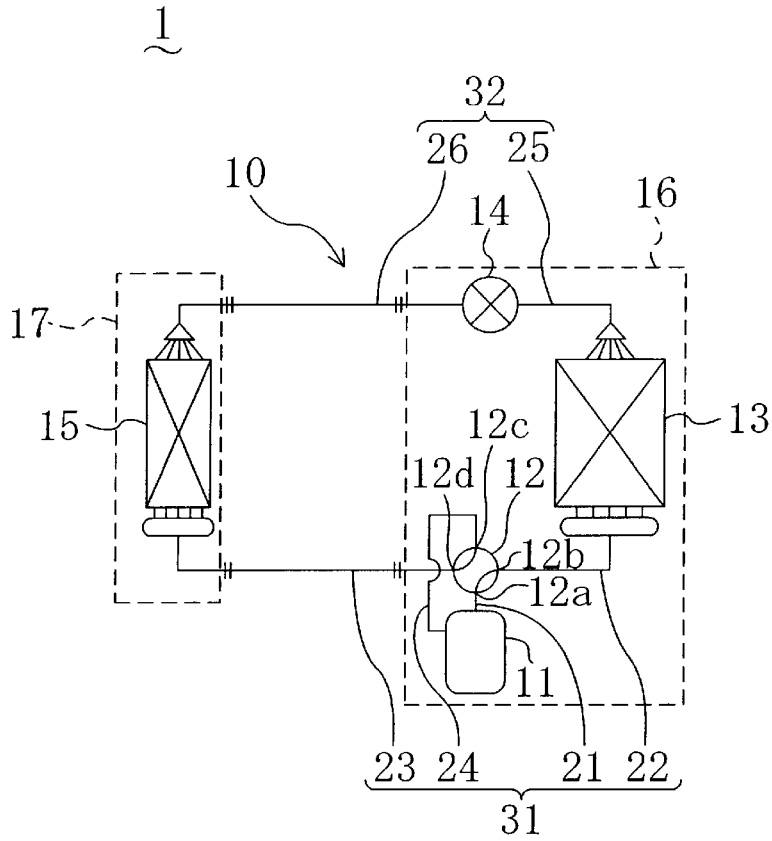
FIG. 1 is a refrigerant circuit diagram of an air conditioning apparatus.

As shown in FIG. 1, a refrigeration system of the present embodiment is an air conditioning apparatus (1) formed by connecting an indoor unit (17) and an outdoor unit (16). A refrigerant circuit (10) of the air conditioning apparatus (1) uses, as its refrigerant, either a single refrigerant of R32 (hereinafter referred to as the R32 single refrigerant) or a mixture of not less than 75 wt. % but less than 100 wt. % R32 and R125 (i.e., an R32 composition rich mixed refrigerant which is hereinafter called the R32/R125 mixed refrigerant).

The refrigerant circuit (10) is a refrigerant circuit forming a vapor compression refrigerating cycle. The refrigerant circuit (10) is formed by connecting, in series and in the order given, a compressor (11), a four-way selector valve (12), an outdoor heat exchanger (13), an expansion valve (14) which is an expansion mechanism, and an indoor heat exchanger (15) through a gas side pipe (31) and a liquid side pipe (32). These pipes (31) and (32) are refrigerant pipes.

More specifically, the outlet side of the compressor (11) and a first port (12*a*) of the four-way selector valve (12) are connected together by a first gas side pipe (21). A second port (12*b*) of the four-way selector valve (12) and the outdoor heat exchanger (13) are connected together by a second gas side pipe (22). The outdoor heat exchanger (13) and the expansion valve (14) are connected together by a first liquid side pipe (25). The expansion valve (14) and the indoor heat exchanger (15) are connected together by a second liquid side pipe (26). The indoor heat exchanger (15) and a third port (12*c*) of the four-way selector valve (12) are connected together by a third gas side pipe (23). A fourth port (12*d*) of the four-way selector valve (12) and the inlet side of the compressor (11) are connected together by a fourth gas side pipe (24).

The compressor (11), the first gas side pipe (21), the four-way selector valve (12), the second gas side pipe (22), the outdoor heat exchanger (13), the first liquid side pipe (25), the expansion valve (14), and the fourth gas side pipe (24) are all housed in an outdoor unit (16), together with an outdoor blower (not shown). On the other hand, the indoor heat exchanger (15) is housed in an indoor unit (17), together with an indoor blower (not shown). A part of the second liquid side pipe (26) and a part of the third gas side pipe (23) constitute a so-called communication pipe for connecting together the outdoor unit (16) and the indoor unit (17).

Heat Exchanger Structure

Since R32 single refrigerant or R32/R125 mixed refrigerant is higher in refrigeration effect per unit volume than R22 refrigerant, t he refrigerant circulation amount necessary for achieving a specified capacity is less than R22. Therefore, for the case of R32 single refrigerant (or R32/R125 mixed refrigerant), if the inside diameter of a heat transfer pipe of a heat exchanger is fixed, this result s in the reduction in refrigerant circulation amount. The loss of tube pressure is reduced in comparison with R22.

Generally, when the inside diameter of a heat transfer pipe of a heat exchanger is reduced, this results in the drop in total system performance due the reduction of heat transfer area and the increase of refrigerant pressure loss. However, if R32 single refrigerant or R32/R125 mixed refrigerant is used, such refrigerant, since its refrigerant side heat transfer rate in the heat transfer pipe is larger than R22, achieves the same total performance as R22 or a better total performance than R22, even when the loss of tube pressure is increased up to a corresponding level to R22.

Apart from the above, in the outdoor heat exchanger (13) the largest section in refrigerant holding amount is the refrigerant circuit (10). Accordingly, if the diameter of the heat transfer pipe of the outdoor heat exchanger (13) is reduced, this makes it possible to effectively reduce the charging amount of refrigerant. Further, such reduction in heat transfer pipe diameter reduces the dimensions of the outdoor and indoor heat exchangers (13) and (15), thereby making it possible to promote the compacting of the outdoor and indoor units (16) and (17).

Therefore, in the air conditioning apparatus (1) of the present embodiment, the diameter of heat transfer pipes for the outdoor and indoor heat exchangers (13) and (15) is reduced to such an extent that tube pressure is lost at the same level as R22. More specifically, in the air conditioning apparatus (1) of the present embodiment, a variation in the refrigerant saturation temperature corresponding to a pressure loss amount in the heat transfer pipe is considered and the inside diameters of heat transfer pipes for the outdoor and indoor heat exchangers (13) and (15) are set so that the temperature variation becomes the same as R22.

Basic Principle of Heat Transfer Pipe Structure

Next, a basic principle of constituting heat transfer pipes for the outdoor and indoor heat exchangers (13) and (15) will be described in detail.

Figure 2:
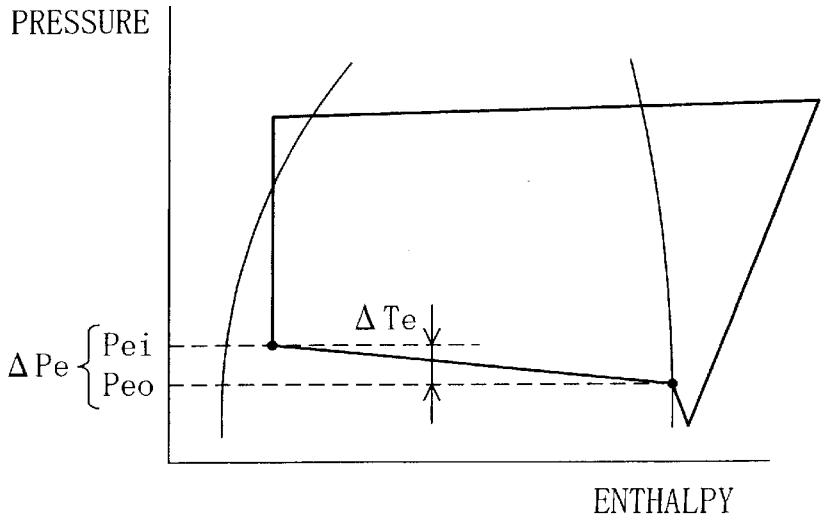
FIG. 2 is a Mollier diagram.

Here, as shown in FIG. 2, each heat transfer pipe for the outdoor and indoor heat exchangers (13) and (15) is set such that the saturation temperature variation ΔTe corresponding to the pressure loss of evaporation refrigerant becomes the same as that of R22 in a conventional system. That is, $$\Delta Te = \text{Const.} \tag{1}$$

Here,

ΔP: pipe pressure loss (kPa)

L: pipe length (m)

G: refrigerant circulation amount (kg/s)

A: flowpath cross-sectional area ($m^2$)

λ: loss coefficient d: pipe inside diameter (m)

ρs: compressor suction refrigerant density ($kg/m^3$)

And, the saturation temperature variation ΔTe is given by the following expression.

$$\Delta Te = \{\Delta T/\Delta P\} \times \Delta Pe \tag{2}$$

The pressure loss ΔP is calculated using the following expression which is a friction loss expression for annular pipe.

$$\Delta P = \lambda \cdot L/d \cdot G^2/2 \cdot \rho s \cdot A^2 \tag{3}$$

If the cooling capacity Q=G×Δh is constant, then:

$$\Delta P \propto G^2/\rho s \cdot d^5 \propto (\Delta h^2 \cdot \rho s \cdot d^5)^{-1} \tag{4}$$

where Δh is the refrigeration effect (kJ/kg). Therefore, from the expressions (2) and (4), the pressure loss ΔP is given by:

$$\Delta Te \propto \{\Delta T/\Delta P\} \times (\Delta h^2 \cdot \rho s \cdot d^5)^{-1} \tag{5}$$

Hence, from the expressions (1) and (5) and from the material property values of refrigerants R22 and R32, the inside diameter ratio of a heat transfer pipe for R32 to a heat transfer pipe for R22, i.e., the heat transfer pipe diameter reducing ratio, can be found by the following expression.

$$\{\Delta T/\Delta P\}_{22} \times (\Delta h_{22}^2 \cdot \rho s_{22} \cdot d_{22}^5)^{-1} = \{\Delta T/\Delta P\}_{32} \times (\Delta h_{32}^2 \cdot \rho s_{32} \cdot d_{32}^5)^{-1}$$

$$d_{32}/d_{22} = ((\Delta h_{32}/\Delta h_{22})^2 \times \rho s_{32}/\rho s_{22} \times (\{\Delta T/\Delta P\}_{32}/\{\Delta T/\Delta P\}_{22})^{-1})^{-1/5} \tag{6}$$

Referring to FIG. 3, there are shown results of calculations found by substitution of each material property value into the expression (6). In the calculations, it is assumed that the evaporation temperature Te is 2 degrees centigrade and the condensation temperature is 49 degrees centigrade, and the evaporator outlet super heat SH=5 deg and the condenser outlet sub cool SC=5 deg.

The calculation results show that the diameter of an R32 heat transfer pipe is reduced about 0.76 times that of an R22 heat transfer pipe. Further, the calculation results show that the diameter of an R32/R125 heat transfer pipe is reduced about 0.76–0.8 times that of an R22 heat transfer pipe. The same calculations were performed on other replacement refrigerants for reference and the calculation results show that none of them achieved better reduction in diameter than R32 (see FIG. 3).

In the air conditioning apparatus (1) of the present embodiment, based upon the aforesaid principle, heat transfer pipes having the following inside diameters relative to the R22 heat transfer pipe are employed.

That is, when R32 single refrigerant is used, the heat transfer pipe of the indoor heat exchanger (15) is formed by a heat transfer pipe whose inside diameter is in the range of 4.7 mm to 5.9 mm, whereas the heat transfer pipe of the outdoor heat exchanger (13) is formed by a heat transfer pipe whose inside diameter is in the range of 5.4 mm to 6.7 mm.

On the other hand, when R32/R125 mixed refrigerant is used, the heat transfer pipe of the indoor heat exchanger (15) is formed by a heat transfer pipe whose inside diameter is in the range of 4.7 mm to 6.2 mm, whereas the heat transfer pipe of the outdoor heat exchanger (13) is formed by a heat transfer pipe whose inside diameter is in the range of 5.4 mm to 7.1 mm.

If the inside diameter of each heat transfer pipe falls below the numerical value range, the loss of refrigerant pressure excessively increases, although the charging amount of refrigerant is reduced to a further extent. On the other hand, the inside diameter of each heat transfer pipe exceeds the numerical value range, it becomes difficult to take full advantage of the effect of R32 such as the effect of refrigerant charging amount reduction, although the loss of refrigerant pressure is reduced and there is improvement in system efficiency.

To cope with the above problem, in the present embodiment the inside diameters of heat transfer pipes for the outdoor and indoor heat exchangers (13) and (15) are so set as to fall in the aforesaid numerical value ranges.

Of course, there may be made further restrictions on the numerical value ranges for allowing R32 to exhibit its characteristics more significantly, depending upon the system use condition or the like.

For example, when R32 single refrigerant is used, the heat transfer pipe of the indoor heat exchanger (15) may be formed by a heat transfer pipe whose inside diameter is in the range of 4.9 mm to 5.7 mm, whereas the heat transfer pipe of the outdoor heat exchanger (13) may be formed by a heat transfer pipe whose inside diameter is in the range of 5.6 mm to 6.5 mm.

Further, when R32 single refrigerant is used, the heat transfer pipe of the indoor heat exchanger (15) may be formed by a heat transfer pipe whose inside diameter is in the range of 5.1 mm to 5.5 mm, whereas the heat transfer pipe of the outdoor heat exchanger (13) may be formed by a heat transfer pipe whose inside diameter is in the range of 5.8 mm to 6.3 mm.

On the other hand, when R32/R125 mixed refrigerant is used, the heat transfer pipe of the indoor heat exchanger (15) may be formed by a heat transfer pipe whose inside diameter is in the range of 4.9 mm to 6.0 mm, whereas the heat transfer pipe of the outdoor heat exchanger (13) may be formed by a heat transfer pipe whose inside diameter is in the range of 5.6 mm to 6.9 mm.

Further, when R32/R125 mixed refrigerant is used, the heat transfer pipe of the indoor heat exchanger (15) may be formed by a heat transfer pipe whose inside diameter is in the range of 5.2 mm to 5.7 mm, whereas the heat transfer pipe of the outdoor heat exchanger (13) may be formed by a heat transfer pipe whose inside diameter is in the range of 5.9 mm to 6.6 mm.

Figure 4:
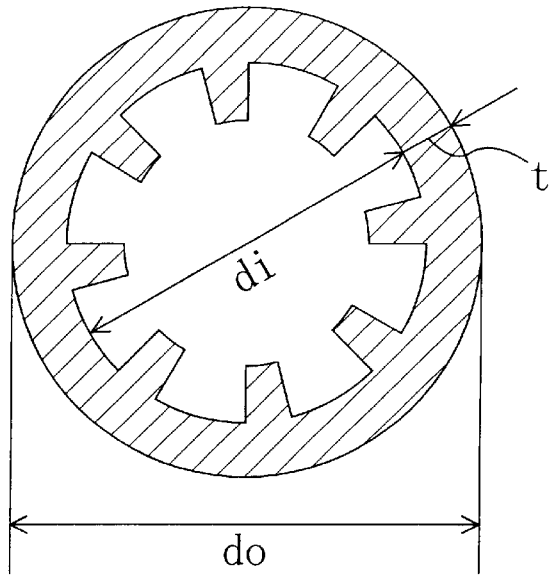
FIG. 4 is a cross-sectional view of a pipe with grooves.

Here, by "the inside diameter of a heat transfer pipe" for the case of internal side smoothed pipes is meant a pipe inside diameter after pipe expansion. Further, as shown in FIG. 4, by "the inside diameter of a heat transfer pipe" for the case of internal side grooved pipes is meant a value which is a remainder of subtracting from an outside diameter after pipe expansion a value which is twice the bottom thickness, i.e., the inside diameter di=do−2t.

Various heat transfer pipes, such as a pipe made of copper or aluminum, are available. The outdoor and indoor heat exchangers (13) and (15) of the present embodiment are each formed by a plate fin tube heat exchanger comprising a copper pipe and an aluminum fin as an air heat exchanger capable of exchanging heat with air. Therefore, their heat transfer pipes are copper pipes.

Refrigerant Pipe Structure

Further, in the air conditioning apparatus (1) of the present embodiment, not only heat transfer pipes for the heat exchangers (13, 15) but also a refrigerant pipe for the refrigerant circuit (10) is diameter reduced with a view to achieving reduction in the refrigerant charging amount.

As described above, if R32 single refrigerant or R32/R125 mixed refrigerant is used intact in an existing refrigerant pipe for R22, the loss of refrigerant pressure is reduced. Therefore, if the inside diameter of the liquid side pipe (32) of the refrigerant circuit (10) is reduced for increasing the loss of tube pressure to the same level as R22, this maintains the system performance at the same level as conventional system. Therefore, in the air conditioning apparatus (1) of the present embodiment, the liquid side pipe (32) is diameter reduced to such an extent that the loss of pipe pressure becomes equivalent to that of R22, for reducing the charging amount of refrigerant of the refrigerant circuit (10) while maintaining the system performance.

On the other hand, if the gas side pipe (31), particularly the fourth gas side pipe (24) which serves as a suction pipe for the compressor (11), is diameter reduced, the system efficiency drops greatly by the influence of increase in the suction pressure loss, although the reduction of refrigerant charging amount is not great as expected. Such a drop in the system efficiency will indirectly give rise to global warming.

Therefore, in the air conditioning apparatus (1) of the present embodiment, the gas side pipe (31) is the same as a commonly-used R22 gas side pipe and only the diameter of the liquid side pipe (32) is made smaller that that of conventional R22 liquid side pipes.

Basic Principle of Refrigerant Pipe Structure

Next, a basic principle of forming the liquid side pipe 32 will be described.

Figure 5:
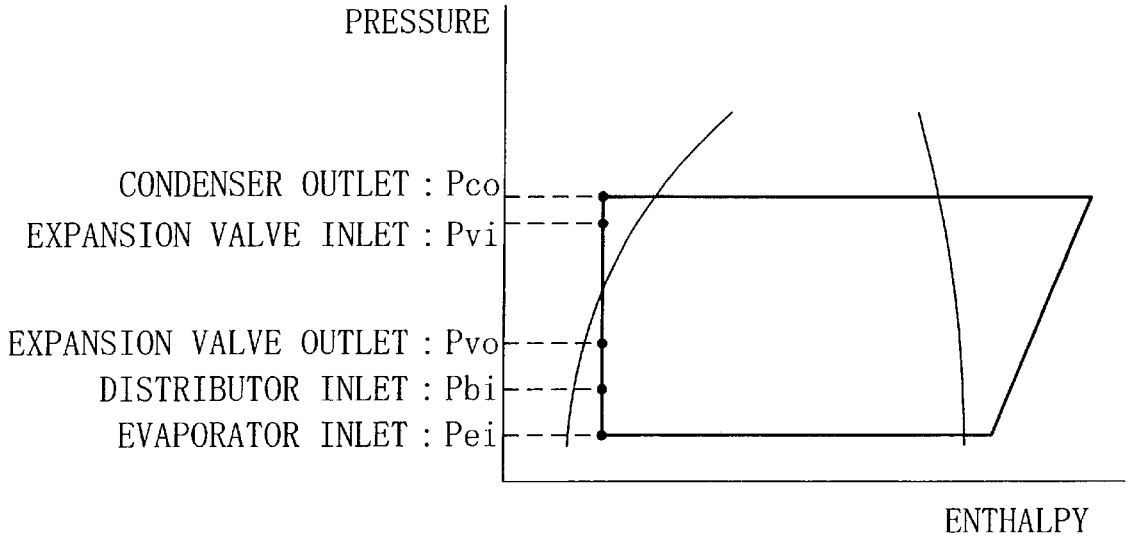
FIG. 5 is a Mollier diagram.

Here, the liquid side pipe (32) is designed such that the ratio of the pressure loss of the liquid side pipe (32) to the drop in refrigerant pressure from the condenser outlet to the evaporator inlet is the same as R22. That is, the following expression, in which the signs shown in FIG. 5 are used, holds as follows.

$$(Pco-Pvi)+(Pvo-Pbi)/(Pco-Pei)=\text{Const.} \quad (7)$$

where:

ΔP: pipe pressure loss (kPa)

L: pipe length (m)

G: refrigerant circulation amount (kg/s)

A: flowpath cross-sectional area ($m^2$)

λ: loss coefficient d: pipe inside diameter (m)

ρs: compressor suction refrigerant density ($kg/m^3$)

Each term of the numerator of the expression (7) is calculated using the following expression which is a friction loss expression for annular pipe.

$$\Delta P=\lambda\cdot L/d\cdot G^2/2\cdot\rho s\cdot A^2 \quad (8)$$

Here, the capacity Q=G×Δh is constant and the following expression is derived from the expression (8).

$$\Delta P\propto G^2/\rho s\cdot d^5\propto(\Delta h^2\cdot\rho s\cdot d^5)^{-1} \quad (9)$$

where:

Δh: refrigeration effect (kJ/kg)

Therefore, the following expression is derived.

$$(Pco-Pvi)+(Pvo-Pbi)\propto(\Delta h^2\cdot\rho s\cdot d^5)^{-1} \quad (10)$$

And, the following expression is derived from the expressions (7) and (10).

$$(Pco-Pvi)+(Pvo-Pbi)/(Pco-Pei)\propto(\Delta h^2\cdot\rho s\cdot d^5)^{-1}/(HP-LP) \quad (11)$$

Therefore, from the expressions (7) and (11) and from the material property values of R22 and R32, the heat transfer pipe diameter reducing ratio of a heat transfer pipe for R32 to a heat transfer pipe for R22 can be found by the following expression.

$$(\Delta h_{22}^2\cdot\rho s_{22}\cdot d_{22}^5)^{-1}/(HP_{22}-LP_{22})=(\Delta h_{32}^2\cdot\rho s_{32}\cdot d_{32}^5)^{-1}/(HP_{32}-LP_{32})$$

$$d_{32}/d_{22}=((\Delta_{32}/\Delta h_{22})^2\times s_{32}/\rho s_{22}\times(HP_{32}-LP_{32})/(HP_{22}-LP_{22})^{-1/5} \quad (12)$$

Referring to FIG. 6, there are shown results of calculations found by substitution of each material property value into the expression (12). Also in the calculations, the evaporation temperature Te is 2 degrees centigrade and the condensation temperature is 49 degrees centigrade, and the super heat SH=5 deg and the sub cool SC=5 deg.

The calculation results show that the diameter of the liquid side pipe (32) of R32 single refrigerant can be reduced about 0.76 times that of an R22 liquid side pipe. Further, the calculation results show that it is possible to reduce the diameter of the liquid side pipe (32) of R32/R125 mixed refrigerant about 0.76–0.8 times that of an R22 liquid side pipe if the R32 composition is present in an amount of not less than 75 wt. %. The same calculations were performed on other replacement refrigerants for reference and the calculation results shows that none of them achieved better reduction in diameter than R32 (see FIG. 6).

Figure 7:
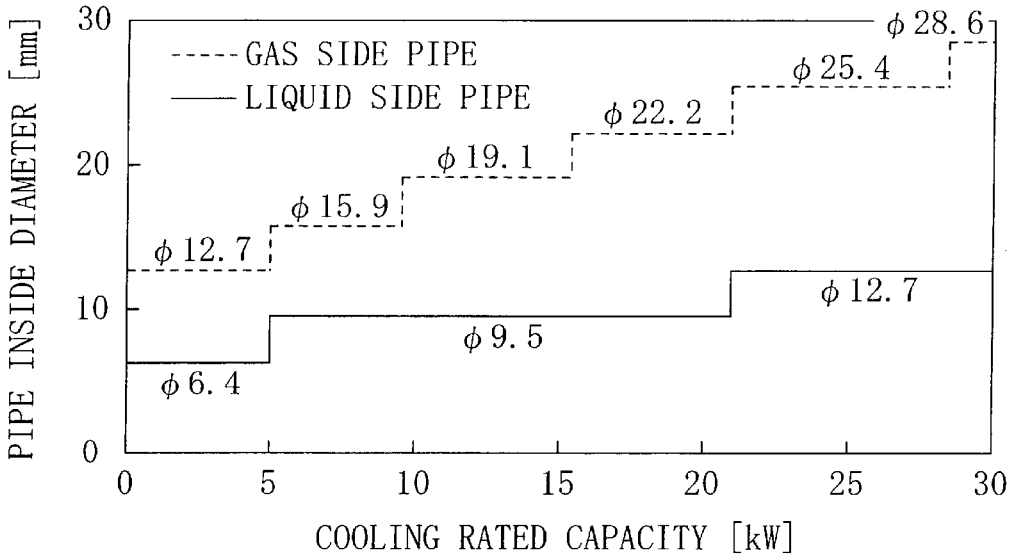
FIG. 7 is a diagram showing gas side pipe diameters and liquid side pipe diameters with respect to the cooling rated capacity.

FIG. 7 is a diagram showing the pipe diameters (inside diameters) of gas side and liquid side pipes per cooling rated capacity in a conventional system using R22.

In the air conditioning apparatus (1) of the present embodiment, according to cooling rated capacity, the gas side pipe (31) is formed by a pipe having the same diameter as the aforesaid R22 gas side pipe, whereas the liquid side pipe (32) is formed by a pipe having a diameter smaller than that of the R22 liquid side pipe.

Figure 8:
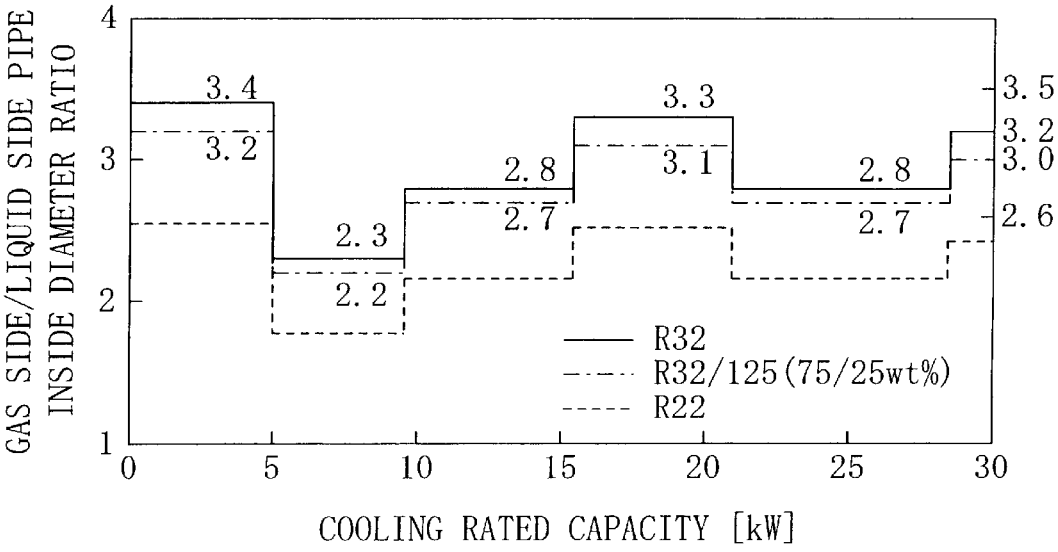
FIG. 8 is a diagram showing the inside diameter ratio of a gas side pipe to a liquid side pipe with respect to the cooling rated capacity.

FIG. 8 is a diagram showing the ratio of the inside diameter dg of gas side pipe to the inside diameter dl of liquid side pipe, i.e., the inside diameter ratio (=the gas side pipe inside diameter dg/the liquid side pipe inside diameter dl). In the air conditioning apparatus (1) of the present embodiment, according to the cooling rated capacity, the gas side pipe (31) and the liquid side pipe (32) having the following inside diameter ratios are used.

That is, if the cooling rated capacity is more than 5 kW but not more than 9 kW, then the inside diameter ratio of the gas side pipe (31) to the liquid side pipe (32) is in the range 2.1 to 3.5. If the cooling rated capacity is not more than 5 kW or more than 9 kW, the inside diameter ratio of the gas side pipe (31) to the liquid side pipe (32) is in the range of 2.6 to 3.5.

Further, if the cooling rated capacity is not more than 5 kW, the liquid side pipe (32) is formed by a pipe whose inside diameter is in the range of 3.2 mm to 4.2 mm. If the cooling rated capacity is more than 5 kW but less than 22.4 kW, the liquid side pipe (32) is formed by a pipe whose inside diameter is in the range of 5.4 mm to 7.0 mm. If the cooling rated capacity is not less than 22.4 kW, the liquid side pipe (32) is formed by a pipe whose inside diameter is in the range of 7.5 mm to 9.8 mm.

If the inside diameter ratio or the inside diameter of the liquid side pipe (32) falls below the aforesaid numerical value range, the system performance drops, although the refrigerant charging amount is further reduced. On the other hand, the inside diameter ratio or the inside diameter of the liquid side pipe (32) exceeds the aforesaid numerical value range, the effect of refrigerant charging amount reduction diminishes, although the refrigerant pressure loss is reduced and the system performance is therefore improved.

To cope with the above problem, in the present embodiment the inside diameters of the gas side pipe (31) and the liquid side pipe (32) are set to fall in the aforesaid numerical value ranges so that the refrigerant charging amount is sufficiently reduced while maintaining the system performance.

Of course, there may be made further restrictions on the numerical value ranges, depending upon the system use condition or the like.

For example, if the cooling rated capacity is more than 5 kW but not more than 9 kW, the inside diameter ratio may be so restricted as to fall in the range of 2.4 to 3.2. If the cooling rated capacity is not more than 5 kW or more than 9 kW, the inside diameter ratio may be so restricted as to fall in the range of 2.8 to 3.3.

Further, if the cooling rated capacity is more than 5 kW but not more than 9 kW, the inside diameter ratio may be so restricted as to fall in the range from 2.6 to 3.0. If the cooling rated capacity is not more than 5 kW or more than 9 kW, the inside diameter ratio is so restricted as to fall in the range of 2.9 to 3.1.

Further, the inside diameter of the liquid side pipe (32) may be so set as to fall in the range of 3.5 mm to 3.9 mm if the cooling rated capacity is not more than 5 kW. If the cooling rated capacity is more than 5 kW but less than 22.4 kW, the inside diameter of the liquid side pipe (32) may be so set as to fall in the range of 5.7 mm to 6.7 mm. If the cooling rated capacity is not less than 22.4 kW, the inside diameter of the liquid side pipe (32) may be so set as to fall in the range of 7.8 mm to 9.5 mm.

Further, the inside diameter of the liquid side pipe (32) may be so set as to fall in the range of 3.6 mm to 3.8 mm if the cooling rated capacity is not more than 5 kW. If the cooling rated capacity is more than 5 kW but less than 22.4 kW, the inside diameter of the liquid side pipe (32) may be so set as to fall in the range of 6.0 mm to 6.4 mm. If the cooling rated capacity is not less than 22.4 kW, the inside diameter of the liquid side pipe (32) may be so set as to fall in the range of 8.1 mm to 9.1 mm.

Copper pipes have been used as a refrigerant pipe in many cases because they are inexpensive and easy to handle. Since various standardized copper pipes are available, it is possible to reduce the cost of the refrigerant pipes (31, 32) by utilizing existing standardized articles. Accordingly, for the purpose of reducing the system cost, both the liquid side pipe (32) and the gas side pipe (31) are preferably formed by combining only standardized articles so that the aforesaid inside diameter ratio is achieved.

Figures 9, 10:
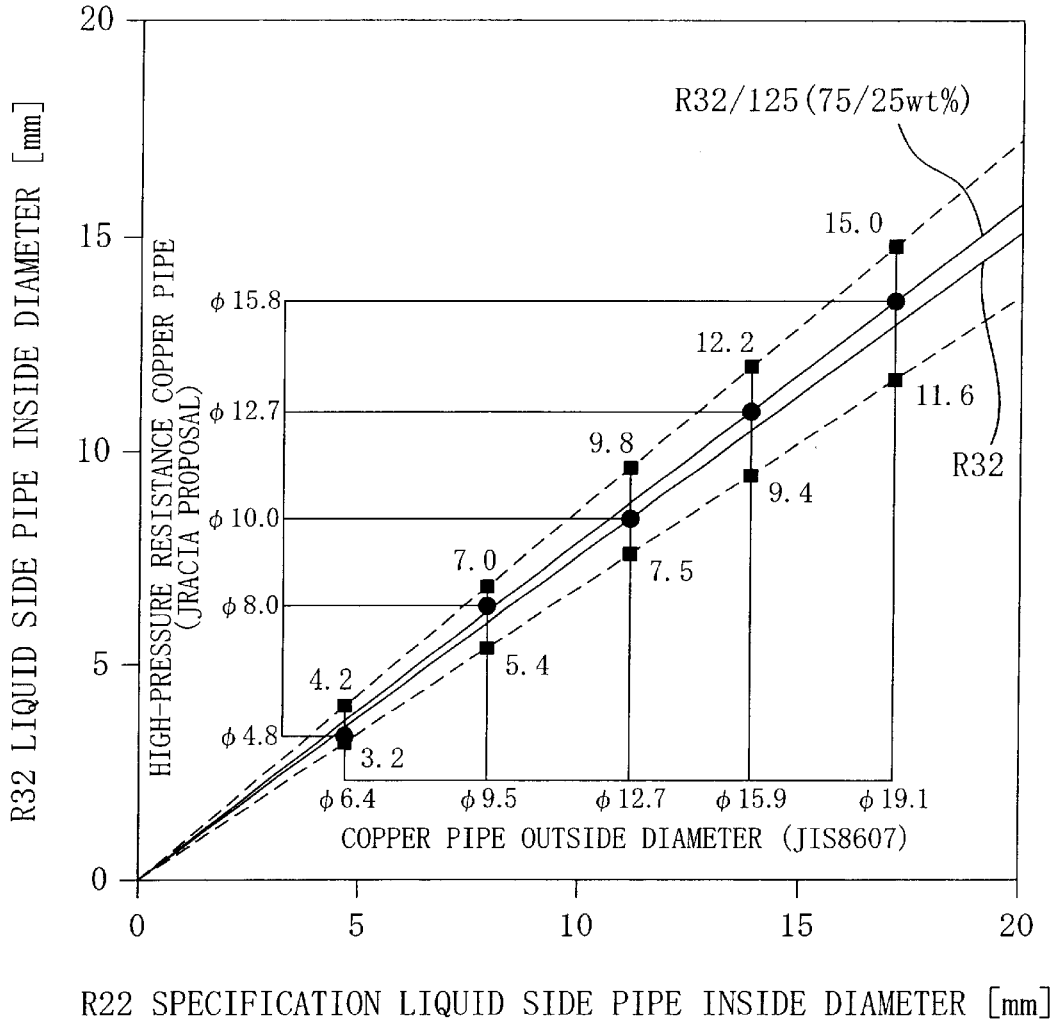
FIG. 9 is a diagram showing an R22 copper pipe versus R32 copper pipe relationship.
FIG. 10 is a table showing GWPS.

FIG. 9 is a diagram for comparing the specification of an R22 copper pipe (JISB8607) and that of an R32 high-pressure resistance pipe according to a proposal by Japanese Refrigeration Air Conditioning Industrial Association.

For the case of R32 single refrigerant, its best inside diameter ratio calculated from the aforesaid calculation results is 0.76, whereas for the case of R32/R125 mixed refrigerant in which R32 is present in amount of 75 wt. % its best inside diameter ratio is 0.80. FIG. 9 shows that within ±10% of the best inside diameter ratios they can be realized easily by the combination of standardized articles.

For example, instead of using a standardized pipe of ϕ9.5 mm for R22, a standardized pipe of ϕ8.0 mm can be used if R32 is used. The present embodiment is an embodiment capable of being implemented easily by a combination of standardized articles.

Running Operation of Air Conditioning Apparatus (1)

Running operation of the air conditioning apparatus (1) will be described based on the refrigerant circulation operation of the refrigerant circuit (10).

During cooling operation, the four-way selector valve (12) is set to the solid line side as shown in FIG. 1. That is, the four-way selector valve (12) is placed in such a state that the first port (12*a*) is brought into communication with the second port (12*b*) while the third port (12*c*) is brought into communication with the second port (12*d*).

In such a state, gas refrigerant discharged out of the compressor (11), after flowing through the first gas side pipe (21), the four-way selector valve (12), and the second gas side pipe (22), condenses to change to liquid refrigerant in the outdoor heat exchanger (13). The liquid refrigerant, after flowing out of the outdoor heat exchanger (13), flows through the first liquid side pipe (25) and is depressurized in the expansion valve (14) to change to gas-liquid two-phase refrigerant. The two-phase refrigerant, after flowing out of the expansion valve (14), flows through the second liquid side pipe (26). Thereafter, the two-phase refrigerant exchanges heat with indoor air in the indoor heat exchanger (15) and evaporates to change to gas refrigerant, whereby the indoor air is cooled. The gas refrigerant, after flowing out of the indoor heat exchanger (15), flows through the third gas side pipe (23), the four-way selector valve (12), and the fourth gas side pipe (24) and thereafter is drawn into the compressor (11).

On the other hand, during heating operation, the four-way selector valve (12) is set to the broken line side as shown in FIG. 1. That is, the four-way selector valve (12) is placed in such a state that the first port (12*a*) is brought into communication with the fourth port (12*d*) while the second port (12*d*) is brought into communication with the third port (12*c*).

In such a state, gas refrigerant discharged out of the compressor (11), after flowing through the first gas side pipe (21), the four-way selector valve (12), and the third gas side pipe (23), enters the indoor heat exchanger (15). The refrigerant, which has flowed into the indoor heat exchanger (15), exchanges heat with indoor air in the indoor heat exchanger (15) and condenses to change to liquid refrigerant, whereby the indoor air is heated. The liquid refrigerant, after flowing out of the indoor heat exchanger (15), flows through the second liquid side pipe (26) and is depressurized in the expansion valve (14) to change to gas-liquid two-phase refrigerant. The two-phase refrigerant, after flowing out of the expansion valve (14), flows through the first liquid side pipe (25) and evaporates to change to gas refrigerant in the outdoor heat exchanger (13). The gas refrigerant, after flowing out of the outdoor heat exchanger (13), flows through the second gas side pipe (22), the four-way selector valve (12), and the fourth gas side pipe (24) and thereafter is drawn into the compressor (11).

Effects of the Present Embodiment

In accordance with the present embodiment, since R32 single refrigerant or R32/R125 mixed refrigerant is used as a refrigeration system refrigerant and the liquid side pipe (32) is formed by a pipe of relatively small diameter, this achieves the reduction in refrigerant charging amount of the refrigerant circuit (10) while maintaining the running efficiency at conventional level. Therefore, it is possible to take full advantage of the characteristics of R32 which is small in GWP as well as in tube pressure loss, thereby greatly contributing to the reduction of global warming effect.

Further, since the heat transfer pipes for the indoor and outdoor heat exchangers (13, 15) are lessened in diameter, this further reduces the refrigerant charging amount. The global warming effect is further reduced.

Additionally, heat transfer pipes for the outdoor and indoor heat exchangers (13, 15) are diameter reduced, thereby making it possible to further reduce the refrigerant charging amount and global warming effect.

Furthermore, by virtue of reduction in the heat transfer pipe diameter, it is possible to lower the cost of the outdoor and indoor heat exchangers (13, 15) and to make the size of the outdoor and indoor heat exchangers (13, 15) compact, and the indoor and outdoor units (17, 16) can be downsized.

Other Embodiments

The above-described embodiment of the present invention is intended for air conditioning apparatus of the so-called heat pump type capable of selectively performing cooling or heating operation. However, the applicability of the present invention is not limited to such a heat pump type air conditioning apparatus. For example, the present invention is applicable to cooling-only air conditioning apparatus. Further, the present invention is made applicable to heating-only air conditioning apparatus by setting the inside diameters of the liquid side and gas side pipes (32, 31) per heating rated capacity corresponding to cooling rated capacity or by setting their inside diameter ratio.

Neither the gas side pipe (31) nor the liquid side pipe (32) is necessarily formed by a copper pipe and these pipes may of course be formed of any other pipe such as a SUS pipe, an aluminum pipe, or an iron pipe.

The indoor and outdoor heat exchangers (13, 15) are not limited to air heat exchangers and they may be liquid-liquid heat exchangers such as a heat exchanger of the double pipe type.

The heat transfer pipes of the outdoor and indoor heat exchanger (13, 15), the gas side pipe (31), and the liquid side pipe (32) are diameter reduced, as a result of which the content volume of the refrigerant circuit (10) (i.e., the content volume of a portion through which refrigerant passes) diminishes. Because of this, the amount of contaminant such as air, moisture, and impurities in the refrigerant circuit (10) is made lower than conventional levels, in other words, the probability that refrigerator lubricant is brought into contact with moisture or the like decreases. Because of this, in accordance with the present embodiment, refrigerator lubricant is unsusceptible to deterioration in comparison with conventional cases. Therefore, in the case synthetic oil, such as ether oil and ester oil, is used as refrigerator lubricant, the advantage of the present embodiment is exhibited more significantly.

The refrigeration system of the present invention is not limited to refrigeration system in a restricted sense. That is, the refrigeration system of the present invention includes a wide range of refrigeration systems such as a refrigerator and a dehumidifier, not to mention air conditioning apparatus.

Further, by "cooling rated capacity" in the aforesaid embodiment is meant an evaporator capacity. The cooling rated capacity is not limited to the capacity of air conditioning apparatus during cooling operation. The cooling rated capacity is a capacity which is achieved under given JIS conditions (indoor dry-bulb temperature: 27 degrees centigrade; outdoor wet-bulb temperature: 19 degrees centigrade; and outdoor dry-bulb temperature: 35 degrees centigrade) where the connection pipe length is 5 m and the difference in level between indoor and outdoor unit is 0 m.

Industrial Applicability

As described above, the refrigeration system of the present invention is advantageous where refrigerants of small ODP is used. The refrigeration system of the present invention is suitable for refrigeration systems truly capable of global warming prevention.

What is claimed is:

1. A refrigeration system comprising a refrigerant circuit (10) forming a refrigerating cycle, wherein a dg/dl ratio, which is the ratio of the diameter dg of a gas side pipe (31) of said refrigerant circuit (10) to the diameter dl of a liquid side pipe (32) of said refrigerant circuit (10), is not less than 2.6.

2. A refrigeration system which uses, as its refrigerant, either a mixture of not less than 75 wt. % but less than 100 wt. % R32 and R125 or a single refrigerant of R32 and which comprises a refrigerant circuit (10) forming a refrigerating cycle, wherein a liquid side pipe (32) and a gas side pipe (31) of said refrigerant circuit (10) are formed such that a dg/dl ratio, which is the ratio of the diameter dg of said gas side pipe (31) to the diameter dl of said liquid side pipe (32), is not less than 2.6.

3. A refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of more than 5 kW but not more than 9 kW, wherein a liquid side pipe (32) and a gas side pipe (31) of said refrigerant circuit (10) are formed such that a dg/dl ratio, which is the ratio of the diameter dg of said gas side pipe (31) to the diameter dl of said liquid side pipe (32), is not less than 2.1.

4. A refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of more than 5 kW but not more than 9 kW, wherein a liquid side pipe (32) and a gas side pipe (31) of said refrigerant circuit (10) are formed such that a dg/dl ratio, which is the ratio of the diameter dg of said gas side pipe (31) to the diameter dl of said liquid side pipe (32), falls in the range of 2.1 to 3.5.

5. A refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of more than 5 kW but not more than 9 kW, wherein a liquid side pipe (32) and a gas side pipe (31) of said refrigerant circuit (10) are formed such that a dg/dl ratio, which is the ratio of the diameter dg of said gas side pipe (31) to the diameter dl of said liquid side pipe (32), falls in the range of 2.4 to 3.2.

6. A refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of more than 5 kW but not more than 9 kW, wherein a liquid side pipe (32) and a gas side pipe (31) of said refrigerant circuit (10) are formed such that a dg/dl ratio, which is the ratio of the diameter dg of said gas side pipe (31) to the diameter dl of said liquid side pipe (32), falls in the range of 2.6 to 3.0.

7. A refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not more than 5 kW or more than 9 kW, wherein a liquid side pipe (32) and a gas side pipe (31) of said refrigerant circuit (10) are formed such that a dg/dl ratio, which is the ratio of the diameter dg of said gas side pipe (31) to the diameter dl of said liquid side pipe (32), is not less than 2.6.

8. A refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not more than 5 kW or more than 9 kW, wherein a liquid side pipe (32) and a gas side pipe (31) of said refrigerant circuit (10) are formed such that a dg/dl ratio, which is the ratio of the diameter dg of said gas side pipe (31) to the diameter dl of said liquid side pipe (32), falls in the range of 2.6 to 3.5.

9. A refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not more than 5 kW or more than 9 kW, wherein a liquid side pipe (32) and a gas side pipe (31) of said refrigerant circuit (10) are formed such that a dg/dl ratio, which is the ratio of the diameter dg of said gas side pipe (31) to the diameter dl of said liquid side pipe (32), falls in the range of 2.8 to 3.3.

10. A refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not more than 5 kW or more than 9 kW, wherein a liquid side pipe (32) and a gas side pipe (31) of said refrigerant circuit (10) are formed such that a dg/dl ratio, which is the ratio of the diameter dg of said gas side pipe (31) to the diameter dl of said liquid side pipe (32), falls in the range of 2.9 to 3.1.

11. A refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not more than 5 kW, wherein a liquid side pipe (32) of said refrigerant circuit (10) is formed by a pipe the inside diameter of which is not more than 4.2 mm.

12. A refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not more than 5 kW, wherein a liquid side pipe (32) of said refrigerant circuit (10) is formed by a pipe the inside diameter of which falls in the range of 3.2 mm to 4.2 mm.

13. A refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not more than 5 kW, wherein a liquid side pipe (32) of said refrigerant circuit (10) is formed by a pipe the inside diameter of which falls in the range of 3.5 mm to 3.9 mm.

14. A refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not more than 5 kW, wherein a liquid side pipe (32) of said refrigerant circuit (10) is formed by a pipe the inside diameter of which falls in the range of 3.6 mm to 3.8 mm.

15. The refrigeration system of any one of claims 12–14, wherein the inside diameter of said liquid side pipe (32) is not more than 3.7 mm.

16. A refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of more than 5 kW but less than 22.4 kW, wherein a liquid side pipe (32) of said refrigerant circuit (10) is formed by a pipe the inside diameter of which is not more than 7.0 mm.

17. A refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of more than 5 kW but less than 22.4 kW, wherein a liquid side pipe (32) of said refrigerant circuit (10) is formed by a pipe the inside diameter of which falls in the range of 5.4 mm to 7.0 mm.

18. A refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of more than 5 kW but less than 22.4 kW, wherein a liquid side pipe (32) of said refrigerant circuit (10) is formed by a pipe the inside diameter of which falls in the range of 5.7 mm to 6.7 mm.

19. A refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of more than 5 kW but less than 22.4 kW, wherein a liquid side pipe (32) of said refrigerant circuit (10) is formed by a pipe the inside diameter of which falls in the range of 6.0 mm to 6.4 mm.

20. The refrigeration system of any one of claims 17–19, wherein the inside diameter of said liquid side pipe (32) is not more than 6.2 mm.

21. A refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not less than 22.4 kW, wherein a liquid side pipe (32) of said refrigerant circuit (10) is formed by a pipe the inside diameter of which is not more than 9.8 mm.

22. A refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not less than 22.4 kW, wherein a liquid side pipe (32) of said refrigerant circuit (10) is formed by a pipe the inside diameter of which falls in the range of 7.5 mm to 9.8 mm.

23. A refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not less than 22.4 kW, wherein a liquid side pipe (32) of said refrigerant circuit (10) is formed by a pipe the inside diameter of which falls in the range of 7.8 mm to 9.5 mm.

24. A refrigeration system which uses, as its refrigerant, either a mixture of not less than 75 wt. % but less than 100 wt. % R32 and R125 or a single refrigerant of R32, which comprises a refrigerant circuit (10) forming a refrigerating cycle, and which has a cooling rated capacity of not less than 22.4 kW, wherein a liquid side pipe (32) of said refrigerant circuit (10) is formed by a pipe the inside diameter of which falls in the range of 8.1 mm to 9.1 mm.

25. The refrigeration system of any one of claims 22–24, wherein the inside diameter of said liquid side pipe (32) is not more than 8.7 mm.

26. The refrigeration system of any one of claims 1–10, wherein said gas side pipe (31) and said liquid side pipe (32) are connecting pipes for connecting an indoor unit (17) and an outdoor unit (16).

27. The refrigeration system of any one of claims 11–14, 16–19, and 21–24, wherein said liquid side pipe (32) is a liquid side connecting pipe for connecting an indoor unit (17) and an outdoor unit (16).

28. The refrigeration system of any one of claims 1–14, 16–19, and 21–24, wherein said refrigerant is a single refrigerant of R32.

* * * * *